US011891212B2

(12) United States Patent
Semma

(10) Patent No.: US 11,891,212 B2
(45) Date of Patent: Feb. 6, 2024

(54) MULTI-COMPARTMENT CONTAINERS

(71) Applicant: My Sunglass Case, LLC, Plano, TX (US)

(72) Inventor: Joseph Semma, Plano, TX (US)

( * ) Notice: Subject to any disclaimer, the term of this patent is extended or adjusted under 35 U.S.C. 154(b) by 0 days.

(21) Appl. No.: 16/996,929

(22) Filed: Aug. 19, 2020

(65) Prior Publication Data

US 2021/0053724 A1 Feb. 25, 2021

Related U.S. Application Data

(60) Provisional application No. 62/889,312, filed on Aug. 20, 2019.

(51) Int. Cl.

| | |
|---|---|
| ***A45C 11/04*** | (2006.01) |
| ***B65D 25/04*** | (2006.01) |
| ***B65D 25/20*** | (2006.01) |
| ***B65D 25/54*** | (2006.01) |
| ***B65D 25/10*** | (2006.01) |
| *A45C 11/18* | (2006.01) |

(52) U.S. Cl.

CPC ..... *B65D 25/04* (2013.01); *A45C 11/04* (2013.01); *B65D 25/102* (2013.01); *B65D 25/20* (2013.01); *B65D 25/54* (2013.01); *A45C 11/046* (2013.01); *A45C 11/182* (2013.01)

(58) Field of Classification Search

CPC ..... A45C 11/04; A45C 11/046; A45C 11/24; A45C 11/26; A45C 13/005; A45C 13/023; A45C 5/08; A45C 7/0018; A45C 7/0045; A45C 7/005; B65D 11/1846; B65D 21/0202; B65D 75/225; B65D 75/245; B65D 81/3283

USPC ..... 206/216–235, 7

See application file for complete search history.

(56) References Cited

U.S. PATENT DOCUMENTS

| | | | | |
|---|---|---|---|---|
| 583,417 | A | 9/1901 | Weinstein | |
| 1,156,767 | A * | 10/1915 | Farrar | B65D 3/10 229/5.5 |
| 1,649,255 | A | 11/1927 | Robinson | |
| 1,683,851 | A * | 9/1928 | Wells | A45C 11/008 206/236 |

(Continued)

FOREIGN PATENT DOCUMENTS

| | | |
|---|---|---|
| JP | 2010075640 | 4/2010 |
| JP | 2019092788 | 6/2019 |

(Continued)

OTHER PUBLICATIONS

Khan 4 Piece Folding Eyewear Case, www.khansunglasses.com, Jan. 28, 2020.

(Continued)

*Primary Examiner* — Mollie Impink

(74) *Attorney, Agent, or Firm* — Moazzam & Associates, LLC

(57) ABSTRACT

A container is presented having multiple compartments to house multiple personal items, such as eyewear. The container has a cylindrical middle section and two hemispheric end sections. Each compartment is joined to an adjacent compartment via a shared hinge and separated from an adjacent compartment via a separating wall that is attached to the shared hinge. The container is low profile, ergonomic, and designed to minimize the volume of space needed for housing multiple eyewear.

18 Claims, 12 Drawing Sheets

(56) References Cited

U.S. PATENT DOCUMENTS

| | | | | | |
|---|---|---|---|---|---|
| 2,726,004 | A * | 12/1955 | McLeod | B65D 21/0201 | 220/23.2 |
| 5,156,289 | A * | 10/1992 | Goof | B65D 11/02 | 206/373 |
| 5,746,346 | A * | 5/1998 | Crilly | B44D 3/121 | 220/23.83 |
| 6,726,004 | B2 | 4/2004 | Watson | | |
| D518,238 | S * | 3/2006 | Chen | D28/82 | |
| D570,682 | S * | 6/2008 | Erden | D9/430 | |
| 8,522,795 | B2 * | 9/2013 | Bouix | A45D 33/008 | 132/301 |
| 8,863,949 | B2 * | 10/2014 | Sun | G02C 13/001 | 206/234 |
| 2008/0105508 | A1 * | 5/2008 | Arcese | A45C 5/08 | 190/20 |
| 2010/0243499 | A1 * | 9/2010 | Slayton | B65D 75/527 | 206/440 |
| 2012/0292205 | A1 * | 11/2012 | Waters | A45C 15/06 | 206/216 |
| 2016/0270499 | A1 * | 9/2016 | Lawrenson | A45C 11/16 | |
| 2017/0071306 | A1 * | 3/2017 | Evans | A45D 34/00 | |
| 2021/0259378 | A1 * | 8/2021 | Jones | A45C 13/02 | |

FOREIGN PATENT DOCUMENTS

| | | | | |
|---|---|---|---|---|
| JP | 6791832 | B2 * | 11/2020 | |
| TW | M390075 | | 10/2010 | |
| WO | WO-03056970 | A1 * | 7/2003 | A45C 11/04 |

OTHER PUBLICATIONS

6 Slots Travel Sunglasses Organizer Folding Design PU Eyeglasses Storage Case Box Multiple Hanging Eyewear Holder Display, Amazon.com, Jan. 28, 2020.

* cited by examiner

MULTI-COMPARTMENT CONTAINERS

This Patent Application claims priority to U.S. Provisional Patent Application Ser. No. 62/889,312, filed Aug. 20, 2019, the content of which is hereby incorporated by reference herein in its entirety into this disclosure.

BACKGROUND OF THE SUBJECT DISCLOSURE

Field of the Subject Disclosure

The present subject disclosure relates to containers. More specifically, the present subject disclosure relates to multi-compartment containers for storing personal effects, such as eyewear.

Background of the Subject Disclosure

Eyewear, including prescription glasses and sunglasses, are commonly used worldwide to correct vision or protect eyes from the harming effects of the sun or bright lights. Persons with compromised vision, whether myopia, hyperopia, astigmatism, or variations thereof, must commonly carry one or more glasses with them to see clearly.

Sunglasses may also be made according to a given prescription so that the user may enable eye protection from the sun or bright lights while also having corrected vision.

Often, persons having eyes which need correction carry a regular prescription glasses, a sunglass with prescription lenses, and other further backup glasses as needed.

Carrying two or more glasses is often cumbersome and inefficient as each eyewear typically needs its own separate container, and takes up a given volume in a pocket, a purse, briefcase, backpack, luggage or other typical transport carrier. Thus, carrying two or more eyewear in its own container often becomes a necessary but cumbersome chore for many people who need them.

SUMMARY OF THE SUBJECT DISCLOSURE

The present subject disclosure describes multi-compartment containers which alleviate the cumbersome task of carrying multiple personal effects, such as eyewear, by consolidating the containers into a single, low profile, ergonomic and efficient carry container. For sake of simplicity, the description and drawings use eyewear as an example of objects which may be used with the present subject disclosure. However, the subject disclosure is not limited to eyewear, and any item or combination of items may be contained, stored, and transported within the described devices, as long as the item has a size and shape which may fit within the compartments as described herein. For example, a device according to the present subject disclosure may be used to transport a pair of glasses, a mobile telephone, credit or identification cards, cash, and makeup. Any other such combination is possible.

In one exemplary embodiment, the present subject disclosure is a container. The container includes a housing; a plurality of compartments positioned within the housing, each compartment adapted to house a single item and separate that item from other items housed in other compartments; and an attaching mechanism to secure the housing to maintain the single item within the compartment.

In another exemplary embodiment, the present subject disclosure is a container. The container includes a housing; a plurality of compartments positioned within the housing, including one central compartment, and two outer compartments, each compartment adapted to house a single item and separate that item from other items housed in other compartments; a low profile hinge connecting the central compartment to each of the two outer compartments, wherein the hinge is positioned below an external surface of the housing when the housing is closed; and an attaching mechanism to secure the housing by connecting the two outer compartments together.

In yet another exemplary embodiment, the present subject disclosure is a container. The container includes a housing with a circular cross section; a plurality of compartments positioned within the housing, including one central compartment, and two outer compartments, each compartment adapted to house a single item and separate that item from other items housed in other compartments; separator walls positioned between each of the compartments; a low profile hinge connecting the central compartment to each of the two outer compartments, wherein the hinge is positioned below an external surface of the housing when the housing is closed; and an attaching mechanism including a magnet to secure the housing by connecting the two outer compartments together

DETAILED DESCRIPTION OF THE SUBJECT DISCLOSURE

Figure 1A:
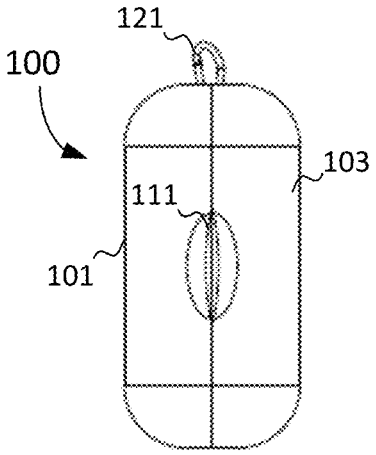
FIG. 1A shows a front view of a closed multi-compartment container, according to an exemplary embodiment of the present subject disclosure.
Figure 1B:
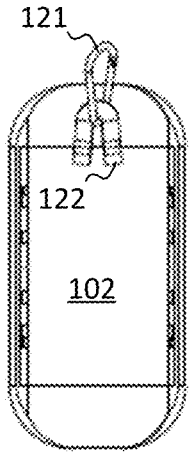
FIG. 1B shows a back view of a closed multi-compartment container, according to an exemplary embodiment of the present subject disclosure.
Figure 1C:
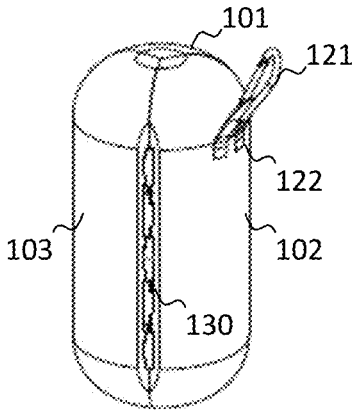
FIG. 1C shows a front perspective view of a closed multi-compartment container, according to an exemplary embodiment of the present subject disclosure.
Figure 1D:
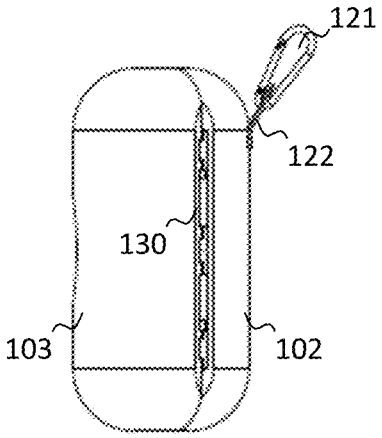
FIG. 1D shows a side view of a closed multi-compartment container, according to an exemplary embodiment of the present subject disclosure.

Particular embodiments of the present subject disclosure will now be described in greater detail with reference to the figures.

The subject disclosure is described with reference to the drawings, wherein like reference numerals are used to refer to like elements throughout. In the following description, for purposes of explanation, numerous specific details are set forth in order to provide a thorough understanding of the present disclosure. It may be evident, however, that the present disclosure may be practiced without these specific details.

As employed in this specification and annexed drawings, the term "or" is intended to mean an inclusive "or" rather than an exclusive "or." Moreover, articles "a" and "an" as used in the subject specification and annexed drawings should generally be construed to mean "one or more" unless specified otherwise or clear from context to be directed to a singular form.

The present subject disclosure addresses the cumbersome task of carrying multiple personal items, such as eyewear, by providing for a single, low profile, space saving, efficient and economic carrier container.

Various exemplary embodiments are shown and described throughout the description and accompany figures. It should be noted that the features shown in different figures may be combined in a way not shown in the examples, and all such possible combinations are not shown for sake of brevity and simplicity. The exemplary embodiments shown display different features which may be mixed, matched, and combined, as desired. FIG. 1 shows an exemplary circular cross section, closed three compartment device, from various views. FIG. 2 shows an exemplary circular cross section, open three compartment device with a loop/strap, from various views. FIG. 3 shows an exemplary circular cross section, open three compartment device with a pocket, from various views. FIG. 4 shows an exemplary circular cross section, open three compartment device with a wallet, from various views. FIG. 5 shows an exemplary circular cross section, open three compartment device with a speaker, from various views. FIG. 6 shows an exemplary circular cross section, open three compartment device with a window, from various views. FIG. 7 shows an exemplary circular cross section, closed three compartment device with electronics, from various views. FIG. 8 shows an exemplary circular cross section, open three compartment device with electronics, from various views. FIG. 9 shows an exemplary circular cross section, open asymmetric three compartment device with a loop/strap, from various views. FIG. 10 shows an exemplary circular cross section, open four compartment device with a loop/strap, from various views. FIG. 11 shows an exemplary oblong cross section, open asymmetric three compartment device, from various views. FIG. 12 shows an exemplary hinge section, which can be used on any of the other exemplary embodiments.

FIGS. 1A-1E show an exemplary embodiment of the present subject disclosure in a closed cylindrical configuration. As shown in FIG. 1, the device is a container 100 which has a circular cross section and has three compartment walls 101, 102, 103, all having the same overall size and shape. Outer compartment walls 101 and 103 are mated on one side with central compartment wall 102 via a hinge 130. Central compartment wall 102 has low profile hinges 130 on both sides to connect with bother outer compartment walls 101, 103.

A lock mechanism 111 secures the two outer compartment walls 101 and 103 together. The securing mechanism may include, for example, clasps, buttons, strings, magnets, zippers, VELCRO, or other mechanism, as recognized by one having ordinary skill in the art. A magnet securing mechanism is shown throughout the figures for sake of simplicity. Alternatively, the securing mechanism may be internal such that a male portion of one mating wall on one outer compartment will interact and mate with a female portion of the other mating wall on the other outer compartment. The securing mechanism may also be a combination of external and internal features.

An attaching device 121, such as a handle, hook, loop, strap, ring, clip, carabiner, etc., is positioned on a ring 122, near one end of the central compartment 102. The attaching device 121 allows the device 100 to be more easily secured onto another object, such as a backpack, luggage, car or bus hook, etc., or simply be carried by hand. The attaching device 121 may be positioned on either end or middle external surface of the container and may be used to attach the container to a rope or clip in a tent during camping so that the container is easily accessible by a user who is camping. Additionally, a strap (not shown) may be used to partially or completely surround the outer circumference of the cylindrical body.

Figure 1E:
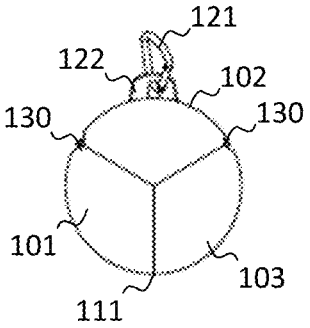
FIG. 1E shows an end view of a closed multi-compartment container, according to an exemplary embodiment of the present subject disclosure.
Figure 2A:
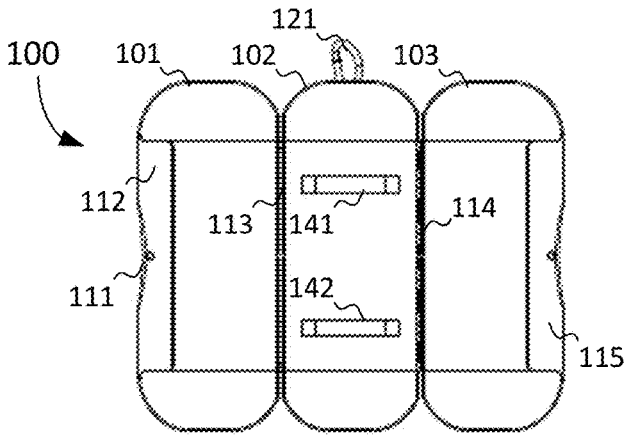
FIG. 2A shows a front view of an open multi-compartment container with a loop/strap, according to an exemplary embodiment of the present subject disclosure.
Figure 2B:
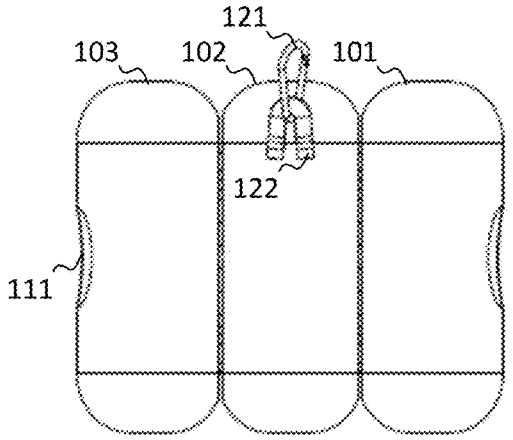
FIG. 2B shows a back view of an open multi-compartment container with a loop/strap, according to an exemplary embodiment of the present subject disclosure.
Figure 2C:
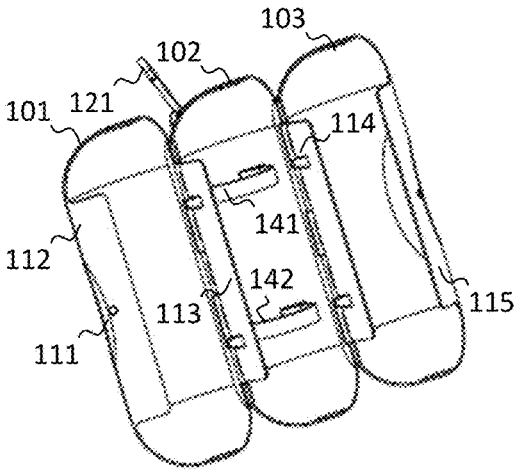
FIG. 2C shows a front perspective view of an open multi-compartment container with a loop/strap, according to an exemplary embodiment of the present subject disclosure.
Figure 2D:
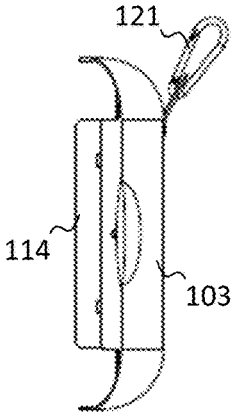
FIG. 2D shows a side view of an open multi-compartment container with a loop/strap, according to an exemplary embodiment of the present subject disclosure.
Figure 2E:
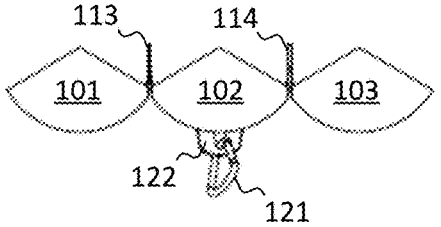
FIG. 2E shows an end view of an open multi-compartment container with a loop/strap, according to an exemplary embodiment of the present subject disclosure.

As shown more clearly in FIGS. 2A-2E, the three compartments walls 101, 102, 103 secure compartments within, including a central compartment and two outer compartments, each compartment is designed to hold a personal object, such as a single eyewear, or multiple smaller eyewear (such as smaller children's eyewear, for example). Compartment walls 101, 102, and 103 will be used synonymously with the compartments 101, 102, and 103 which they define, for sake of simplicity. As best shown in FIGS. 1E/2E, the central compartment 102 is joined on either side by the two outer compartments 101, 103. The two outer compartments 101, 103 each have one side that connects with the central compartment 102, and an adjoining surface which mates with each other during the closing of the container.

As shown best in FIG. 2, when the two end compartments 101, 103 of the container are secured together using a locking mechanism 111, the outer edges of each end of each compartment aligns with the outer edges of each end of each adjoining compartment. As shown in FIG. 1A, the locking mechanism 111 can have a groove which ergonomically assists in the locking and unlocking of the container 100 by a user's fingers. Other shapes that allow for ease of opening of the container 100 are also possible and within the purview of the present disclosure. In the example shown with three compartments, each outer edge of each end of each compartment forms a 120 degree central angle so that the three compartments form a 360 degree connection at a middle longitudinal axis of the container. See FIG. 1E.

Outer compartment wall 101 has a flat mating wall 112 that comes into contact and mates with its complementary flat mating wall 115 on the other outer compartment wall 103. A first separator wall 113 is positioned on the hinge 130 that links outer wall 101 to central wall 102. A second separator wall 114 is positioned on the hinge 130 that links outer wall 103 to central wall 102. Although the mating walls 112 and 115, and the separator walls 113 and 114, are shown in specific positions in the figures (e.g., on the hinge 130), these walls are not limited to those specific positions, and may be positioned anywhere where the compartments converge. Further, any mating wall, or any portion thereof, may be used as a locking mechanism. The two mating walls 112, 115, and the two separator walls 113, 114 all converge when the device 100 is closed to keep the objects contained within the three compartments 101, 102, 103 separate from each other so as to prevent damage from the objects contacting, rubbing, or impacting each other as the closed device 100 is moved or transported.

One or more internal holding devices 141, 142, such as loops or straps, may be used to more firmly secure an object within the compartment 102. Two loops/straps 141, 142 are shown within compartment 102, but any number may be used in one or more of the compartments (not shown for simplicity). The two straps 141, 142 shown within compartment 102 can more securely hold an object, such as glasses, combs, brush handles, lipsticks, eyeliners, pens, cash, etc., within he compartment by securing both ends of the folded glasses.

In other exemplary embodiments, some as described below, the compartments 101, 102, 103 may have different sizes and different angles (other than three equal 120 degree angles) including, for example, three separate sizes for a three compartment container, with each compartment having a different angle, or two compartments having the same size (and angle) and one compartment having a different size (and angle). Additional securing mechanisms may also be used to further secure each of the adjoining end walls to an adjoining end wall.

Further, although the container housing 100 is shown to be circular cylinder, the present subject disclosure may have other shapes as well, including a square cylinder, oval, pentagonal, hexagonal, or others. Alternatively, the overall container cylindrical shape could be oblong, asymmetric, or other shape. FIG. 11 shows an oblong cross section, for example. Most of the examples shown in this disclosure are based on a circular cylinder for sake of simplicity, but other possibilities are also within the scope of the present subject disclosure even if not shown for sake of brevity. However, they would be appreciated and considered part of the present disclosure by one having ordinary skill in the art after consideration of the present disclosure.

Figure 3A:
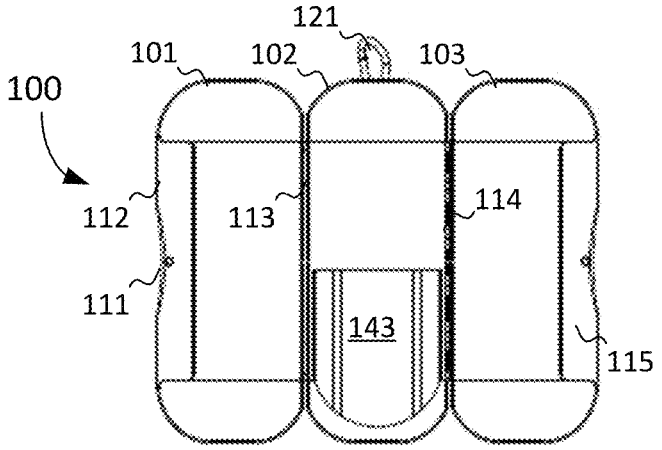
FIG. 3A shows a front view of an open multi-compartment container with a pocket, according to another exemplary embodiment of the present subject disclosure.
Figure 3B:
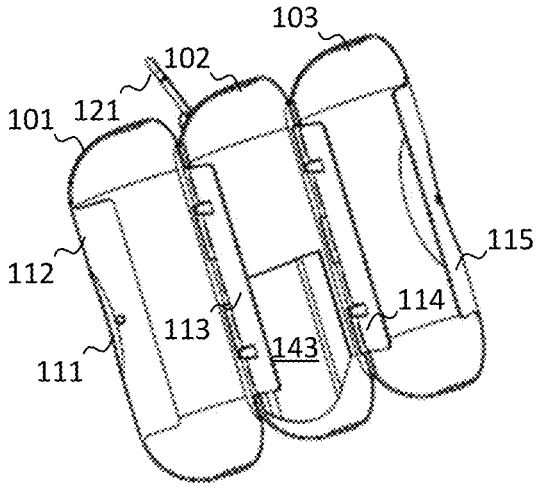
FIG. 3B shows a front perspective view of an open multi-compartment container with a pocket, according to another exemplary embodiment of the present subject disclosure.

FIGS. 3A-3B show another exemplary embodiment of device 100 having three compartments 101, 102, 103, two mating walls 112, 115, two separator walls 113, 114, a lock mechanism 111, and an attaching device 121, such as a carabiner. The exemplary device in FIGS. 3A-3B is substantially the same shape and configuration as the exemplary embodiment shown in FIGS. 1-2, but with a different internal holding device 143. The internal holding device 143 in this example is a pocket 143. The pocket 143 is positioned vertically along the longitudinal axis of the compartment wall 102 and may be used to secure longer, flat objects, such as combs, brush handles, lipsticks, eyeliners, pens, cash, etc. The pocket 143 is shown positioned in the central compartment 102 for sake of simplicity, but one or more pockets 143 may be positioned on any one or more of the internal walls of the three internal compartments 101, 102, 103. Further, the pocket 143 may be in one compartment, while a loop/strap 141/142 (FIG. 2), may be positioned in the same or other compartments.

Figure 4A:
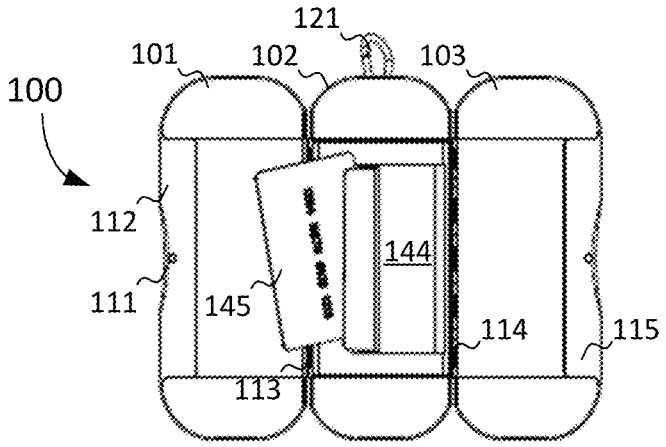
FIG. 4A shows a front view of an open multi-compartment container with a wallet, according to another exemplary embodiment of the present subject disclosure.
Figure 4B:
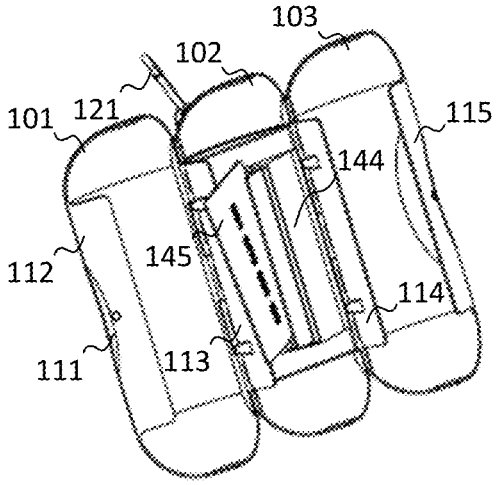
FIG. 4B shows a front perspective view of an open multi-compartment container with a wallet, according to another exemplary embodiment of the present subject disclosure.

FIGS. 4A-4B show another exemplary embodiment of device 100 having three compartments 101, 102, 103, two mating walls 112, 115, two separator walls 113, 114, a lock mechanism 111, and an attaching device 121, such as a carabiner. The exemplary device in FIGS. 4A-4B is substantially the same shape and configuration as the exemplary embodiment shown in FIGS. 1-2, but with a different internal holding device 144. The internal holding device 144 in this example is a wallet 144. The wallet 144 is positioned horizontally along, or perpendicular to, the longitudinal axis of the compartment wall 102 and may be used to secure flat objects, such as flat cards/items 145 including credit cards, ATM cards, identification cards, driver's licenses, cash, etc. The wallet 144 is shown positioned in the central compartment 102 for sake of simplicity, but one or more wallets 144 may be positioned on any one or more of the internal walls of the three internal compartments 101, 102, 103. Further, the wallet 144 may be in one compartment, while a loop/strap 141/142 (FIG. 2), or pocket 143 (FIG. 3) may be positioned in the same or other compartments.

Figure 5A:
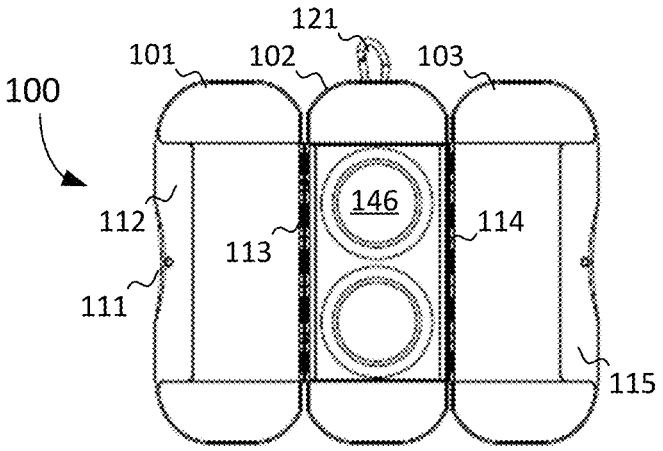
FIG. 5A shows a front view of an open multi-compartment container with a speaker, according to another exemplary embodiment of the present subject disclosure.
Figure 5B:
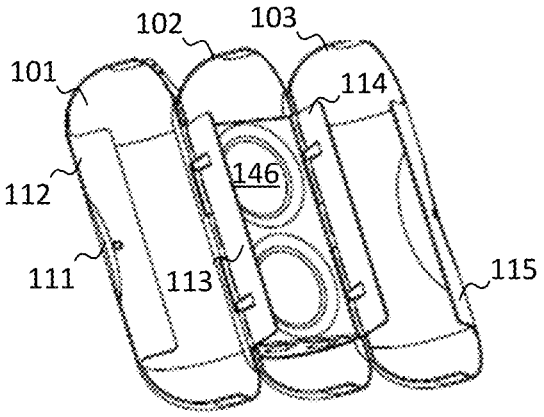
FIG. 5B shows a front perspective view of an open multi-compartment container with a speaker, according to another exemplary embodiment of the present subject disclosure.

FIGS. 5A-5B show another exemplary embodiment of device 100 having three compartments 101, 102, 103, two mating walls 112, 115, two separator walls 113, 114, a lock mechanism 111, and an attaching device 121, such as a carabiner. The exemplary device in FIGS. 5A-5B is substantially the same shape and configuration as the exemplary embodiment shown in FIGS. 1-2, but with an internal speaker 146. The internal speaker 146 is positioned vertically along the longitudinal axis of the compartment wall 102 and may be used to provide portable sound projecting capability to the device 100. The speaker 146 may have an external power port (not shown) or contain an internal power source (such as a battery, not shown), and be able to communicate with external sources of sound through standard wire connections (not shown), or wirelessly (BLUETOOTH, etc.). The speaker 146 is shown positioned in the central compartment 102 for sake of simplicity, but one or more speakers 146 may be positioned on any one or more of the internal walls of the three internal compartments 101, 102, 103. Further, the speaker 146 may be in one compartment, while a loop/strap 141/142 (FIG. 2), pocket 143 (FIG. 3), or wallet 144 (FIG. 4) may be positioned in the same or other compartments.

Figure 6A:
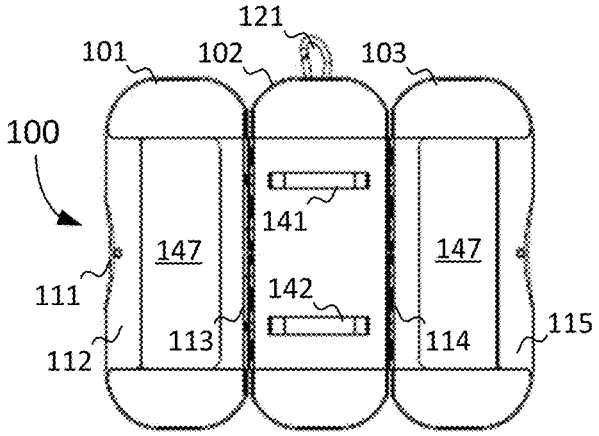
FIG. 6A shows a front view of an open multi-compartment container with a window and a loop/strap, according to another exemplary embodiment of the present subject disclosure.
Figure 6B:
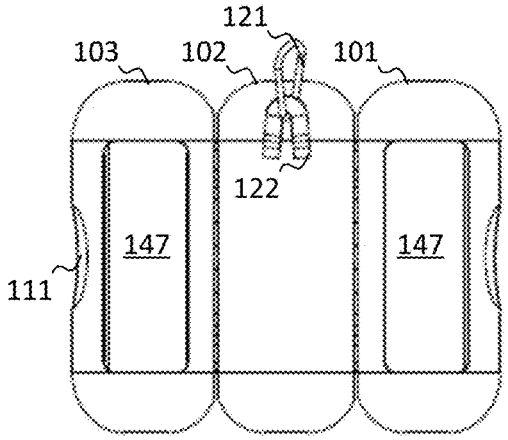
FIG. 6B shows a back view of an open multi-compartment container with a window and a loop/strap, according to another exemplary embodiment of the present subject disclosure.
Figure 6C:
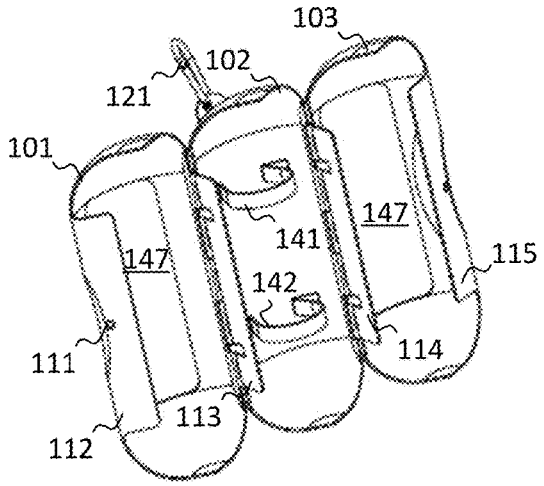
FIG. 6C shows a front perspective view of an open multi-compartment container with a window and a loop/strap, according to another exemplary embodiment of the present subject disclosure.
Figure 7A:
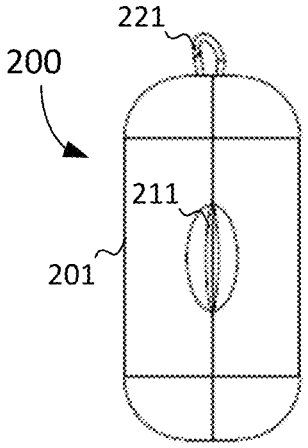
FIG. 7A shows a front view of a closed multi-compartment container with electronics, according to another exemplary embodiment of the present subject disclosure.
Figure 7B:
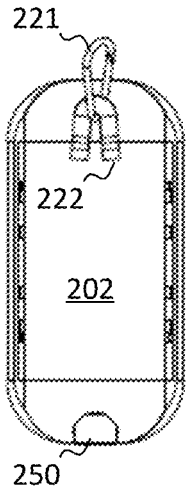
FIG. 7B shows a back view of a closed multi-compartment container with electronics, according to another exemplary embodiment of the present subject disclosure.
Figure 7C:
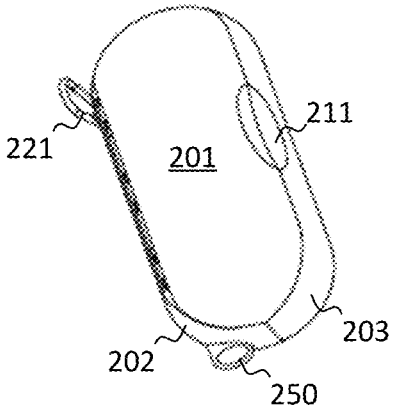
FIG. 7C shows a front perspective view of a closed multi-compartment container with electronics, according to another exemplary embodiment of the present subject disclosure.
Figure 7D:
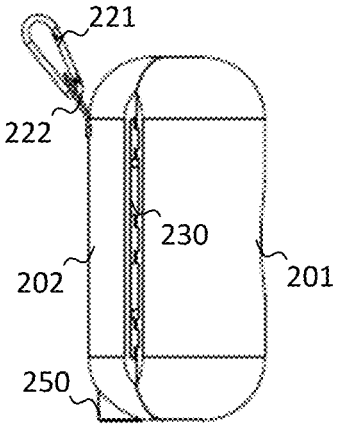
FIG. 7D shows a side view of a closed multi-compartment container with electronics, according to another exemplary embodiment of the present subject disclosure.
Figure 7E:
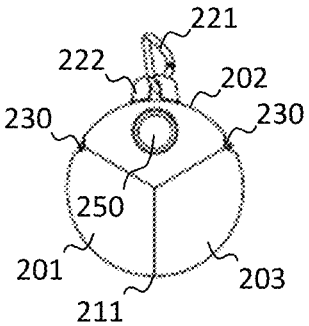
FIG. 7E shows an end view of a closed multi-compartment container with electronics, according to another exemplary embodiment of the present subject disclosure.
Figure 8A:
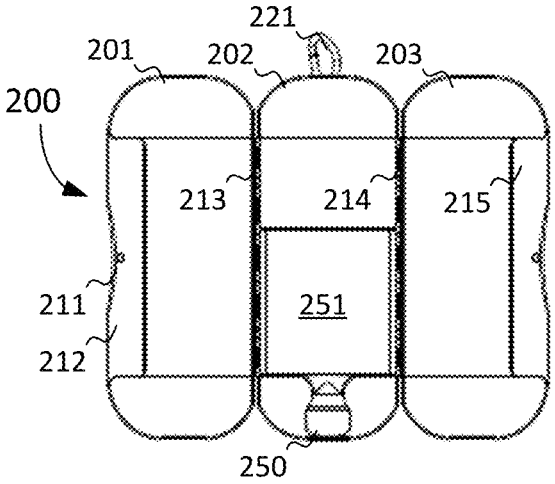
FIG. 8A shows a front view of an open multi-compartment container with electronics, according to another exemplary embodiment of the present subject disclosure.
Figure 8B:
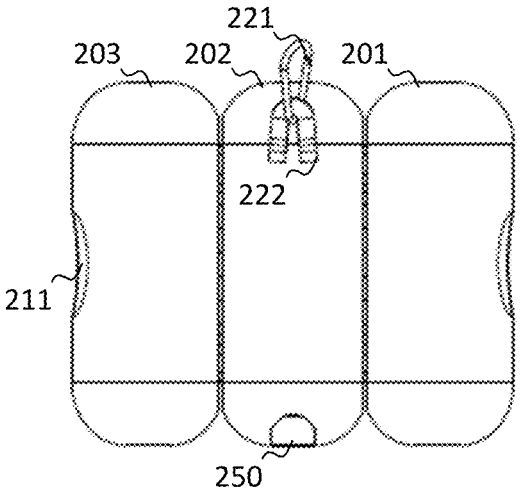
FIG. 8B shows a back view of an open multi-compartment container with electronics, according to another exemplary embodiment of the present subject disclosure.
Figure 8C:
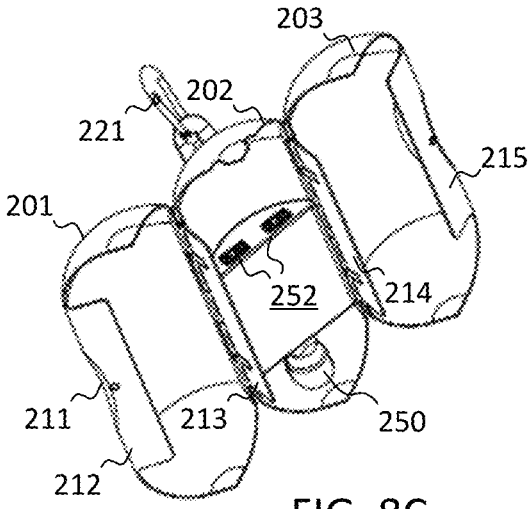
FIG. 8C shows a front perspective view of an open multi-compartment container with electronics, according to another exemplary embodiment of the present subject disclosure.
Figure 8D:
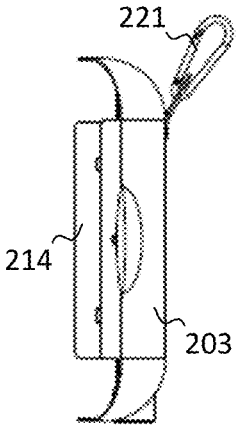
FIG. 8D shows a side view of an open multi-compartment container with electronics, according to another exemplary embodiment of the present subject disclosure.
Figure 8E:
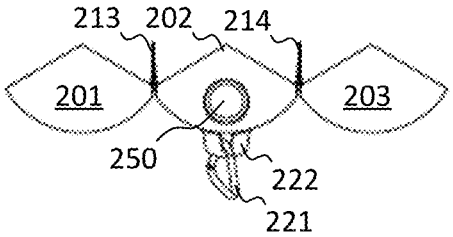
FIG. 8E shows an end view of an open multi-compartment container with electronics, according to another exemplary embodiment of the present subject disclosure.

FIGS. 6A-6*c* show another exemplary embodiment of device 100 having three compartments 101, 102, 103, two mating walls 112, 115, two separator walls 113, 114, a lock mechanism 111, and an attaching device 121 (such as a carabiner) and ring 122. The exemplary device in FIGS. 6A-6C is substantially the same shape and configuration as the exemplary embodiment shown in FIGS. 1-2, but with one or more transparent windows 147, which may be plastic, plexiglass, glass, or the like. Further, the transparent window 147 may include a reflective side (mirror) on the interior of the device 100 so that the user may use the mirror as needed when trying on eyewear. Alternatively, a separate mirror (not shown) may also be included inside of the device 100. The transparent windows 147 are positioned vertically along the longitudinal axis of the compartment wall 101, 102, 103 and may be used to provide a convenient view into the compartments 101, 102, 103 of the device 100 without having to disengage the locking mechanism 111 and open the device 100. The windows 147 allow an easy visual view of the contents of the device 100. The windows 147 are shown positioned in the two end compartments 101, 103 for sake of simplicity, but one or more windows 147 may be of any size and positioned in any one or more of the internal walls of the three internal compartments 101, 102, 103. Further, the window 147 may be in one compartment, while a loop/strap 141/142 (FIG. 2), pocket 143 (FIG. 3), wallet 144 (FIG. 4), or speaker 146 (FIG. 5) may be positioned in the same or other compartments.

FIGS. 7-8 show another exemplary embodiment of device 200, in a closed configuration (FIGS. 7A-7E), and open configuration (FIGS. 8A-8E). The device 200 has three compartments 201, 202, 203, two mating walls 212, 215, two separator walls 213, 214, a lock mechanism 211, and an attaching device 221 (such as a carabiner) and ring 222. The details of the similarly numbered equivalent structures of device 200 to device 100 will not be reiterated for sake of simplicity. The exemplary device in FIGS. 7-8 is substantially the same shape and configuration as the exemplary embodiment shown in FIGS. 1-2, but with one or more electrical components 250, 251, 252.

A power source 251 contains rechargeable or disposable batteries (not shown). Further, the power source 251 may be used to power on a flashlight 250 which is positioned to provide light external to the device 200 whether the device is in a closed (FIG. 7) or open (FIG. 8) configuration. This feature is very useful when a user is carrying the device 200 in a dark parking lot, or other location or occasion when a source of light would be helpful. One or more electrical connection ports 252 are positioned to connect to the power source 250. These ports may be, for example, USB ports to allow an external power source to charge up the batteries within the power source 251, or to have the power source 251 charge up an external device, such as a mobile telephone, tablet, etc. Further, the power source 251 may be charged wirelessly by contact (not shown). One or more of the compartment walls 201, 202, 203 may have an embedded solar power surface (not shown) to enable the solar power charging of the power source 251.

The electrical components 251, 252, 253 are shown positioned in the central compartment 202 for sake of simplicity, but one or more electrical components 251, 252, 253 may be positioned in any one or more of the internal walls of the three internal compartments 201, 202, 203. Further, one or more of the electrical components 251, 252, 253 may be in one compartment, while a loop/strap 141/142 (FIG. 2), pocket 143 (FIG. 3), wallet 144 (FIG. 4), speaker 146 (FIG. 5), or window 147 (FIG. 6) may be positioned in the same or other compartments.

FIGS. 9A-9E show another exemplary embodiment as device 300. The device 300 has three compartments 301, 302, 303, two mating walls 312, 315, two separator walls 313, 314, two loop/straps 341, 342, a lock mechanism 311, and an attaching device 321, such as a carabiner. The details of the similarly numbered equivalent structures of device 300 to device 100 will not be reiterated for sake of simplicity. The exemplary device in FIGS. 9A-9E is substantially the same shape and configuration as the exemplary embodiment shown in FIGS. 1-2, but with the three compartments being different sizes.

Figure 9A:
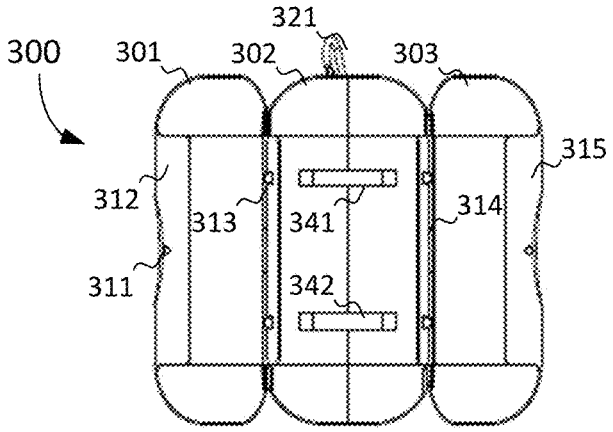
FIG. 9A shows a front view of an open asymmetric multi-compartment container with a loop/strap, according to another exemplary embodiment of the present subject disclosure.
Figure 9B:
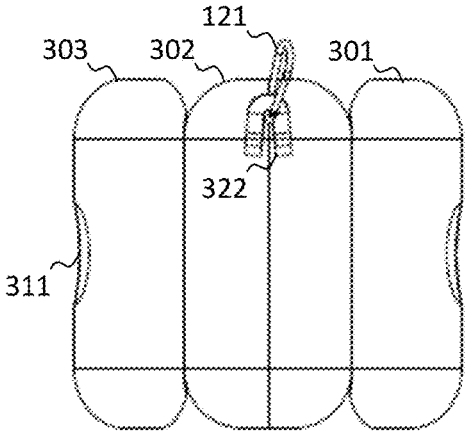
FIG. 9B shows a back view of an open asymmetric multi-compartment container with a loop/strap, according to another exemplary embodiment of the present subject disclosure.
Figure 9C:
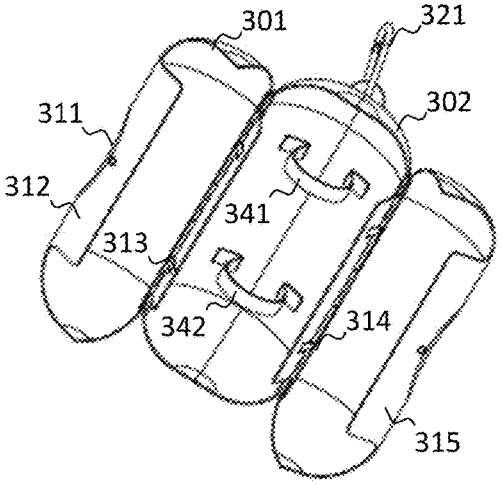
FIG. 9C shows a front perspective view of an open asymmetric multi-compartment container with a loop/strap, according to another exemplary embodiment of the present subject disclosure.
Figure 9D:
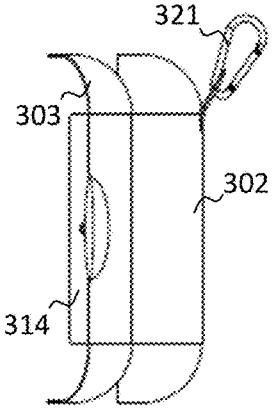
FIG. 9D shows a side view of an open asymmetric multi-compartment container with a loop/strap, according to another exemplary embodiment of the present subject disclosure.
Figure 9E:
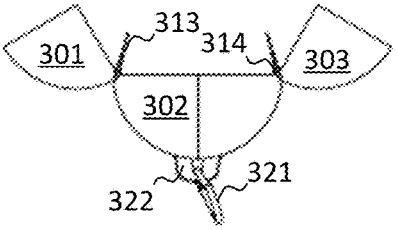
FIG. 9E shows an end view of an open asymmetric multi-compartment container with a loop/strap, according to another exemplary embodiment of the present subject disclosure.
Figure 10A:
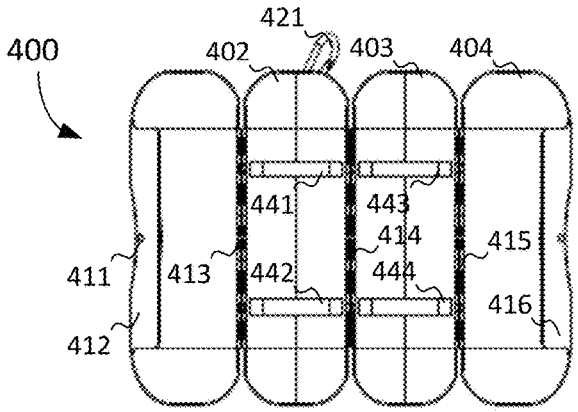
FIG. 10A shows a front view of an open multi-compartment container with a loop/strap, according to another exemplary embodiment of the present subject disclosure.
Figure 10B:
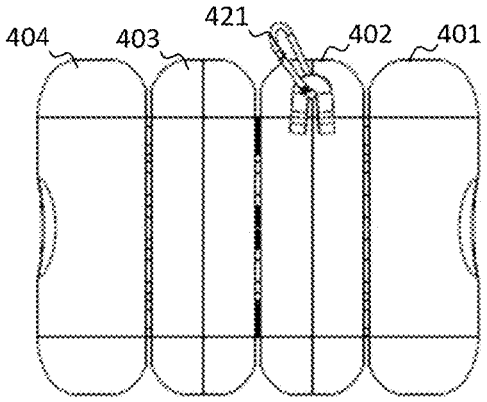
FIG. 10B shows a back view of an open multi-compartment container with a loop/strap, according to another exemplary embodiment of the present subject disclosure.
Figure 10C:
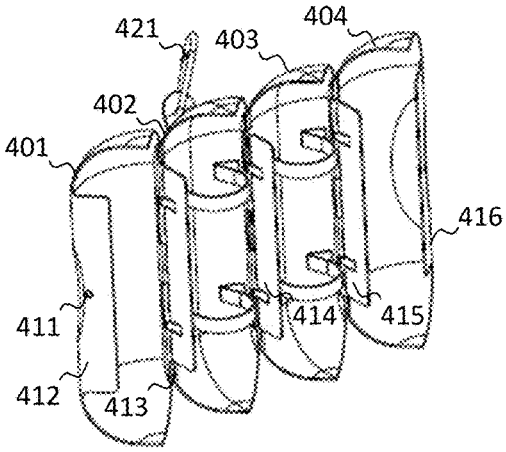
FIG. 10C shows a front perspective view of an open multi-compartment container with a loop/strap, according to another exemplary embodiment of the present subject disclosure.
Figure 10D:
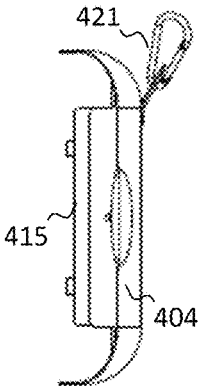
FIG. 10D shows a side view of an open multi-compartment container with a loop/strap, according to another exemplary embodiment of the present subject disclosure.
Figure 10E:
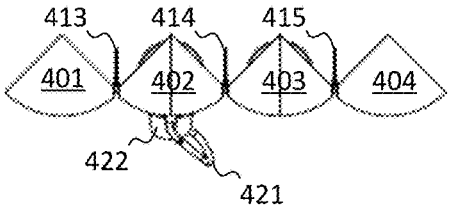
FIG. 10E shows an end view of an open multi-compartment container with a loop/strap, according to another exemplary embodiment of the present subject disclosure.

In this embodiment, as best shown in FIG. 9E, the central compartment 302 is larger than each of the two outer compartments 301 and 303. This allows for a larger volume of space within the central compartment 302 to accommodate larger or bulkier items. For sake of simplicity, central compartment 302 is shown with a 180 degree span, while each of the end compartments has a 90 degree span. However, all three compartments may be different sizes, as long as they can connect together to total a complete circular cross section. The central compartment wall 302 is shown as being the largest, for sake of simplicity, but either of the end compartments 301, 302 may be the largest compartment. The central wall 302 is also shown having two loop/straps 341, 342. However, the asymmetric compartment walls 301, 302, 303 may contain one or more combinations of a loop/strap 141/142 (FIG. 2), pocket 143 (FIG. 3), wallet 144 (FIG. 4), speaker 146 (FIG. 5), window 147 (FIG. 6), or electronics 250/251/252 (FIG. 8).

FIGS. 10A-10E show another exemplary embodiment as device 400. The device 400 has four compartments 401, 402, 403, 404, two mating walls 412, 416, three separator walls 413, 414, 415, four loop/straps 441, 442, 443, 444, a lock mechanism 411, and an attaching device 421, such as a carabiner. The details of the similarly numbered equivalent structures of device 400 to device 100 will not be reiterated for sake of simplicity. The exemplary device in FIGS. 10A-10E is substantially the same shape and configuration as the exemplary embodiment shown in FIGS. 1-2, but with four compartments and three separator walls. In this embodiment, there are two central compartment 402, 403 and two outer compartments 401 and 404. This allows for a different combination of items to be placed within each of the available four compartments. As shown best in FIG. 10E, for sake of simplicity, each compartment 401, 402, 403, 404 is shown with a 90 degree span. However, the four compartments may be different sizes, as long as they can connect together to total a complete circular cross section. Further, although various three compartment and a four compartment configurations have been shown, the present disclosure also encompasses two compartment and multi-compartment (more than four compartments) variations. They further variations have not been shown for sake of brevity, but are included herein, as appreciated by one having ordinary skill in the art. The central walls 402, 403 are shown having two pairs of loop/straps 441/442 and 443/444, respectively. However, each of the compartment walls 401, 402, 403, 404 may contain one or more combinations of a loop/strap 141/142 (FIG. 2), pocket 143 (FIG. 3), wallet 144 (FIG. 4), speaker 146 (FIG. 5), window 147 (FIG. 6), or electronics 250/251/252 (FIG. 8).

FIGS. 11A-11E show another exemplary embodiment as device 500. The device 500 has three compartments 501, 502, 503, and an attaching device 521 (such as a carabiner), and a ring 522. The details of the similarly numbered equivalent structures of device 500 to device 100 will not be reiterated for sake of simplicity. The features shown and described in FIG. 2 are not shown in device 500, for sake of simplicity, but are presumed to be included. The exemplary device 500 in FIGS. 11A-11E is substantially the same shape and configuration as the exemplary embodiment shown in FIGS. 1-2, but with an oblong cross section and having three compartments being different sizes.

Figure 11A:
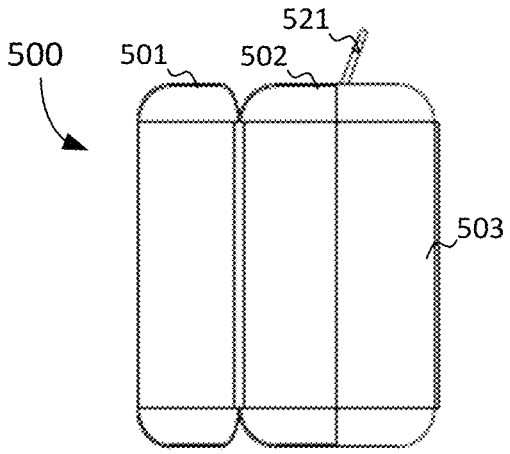
FIG. 11A shows a front view of an open oblong cross section, multi-compartment container with a loop/strap, according to another exemplary embodiment of the present subject disclosure.
Figure 11B:
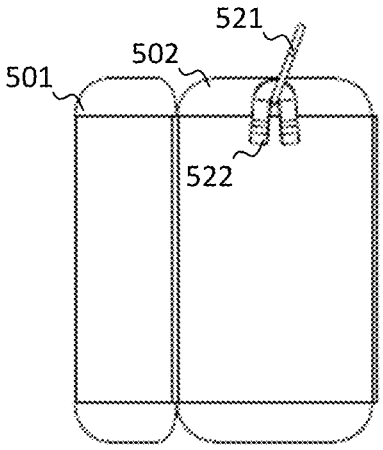
FIG. 11B shows a back view of an open oblong cross section, multi-compartment container with a loop/strap, according to another exemplary embodiment of the present subject disclosure.
Figure 11C:
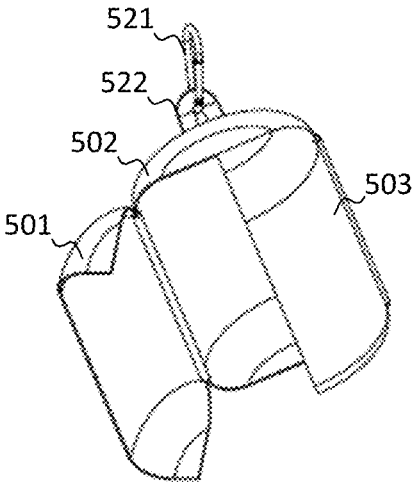
FIG. 11C shows a front perspective view of an open oblong cross section, multi-compartment container with a loop/strap, according to another exemplary embodiment of the present subject disclosure.
Figure 11D:
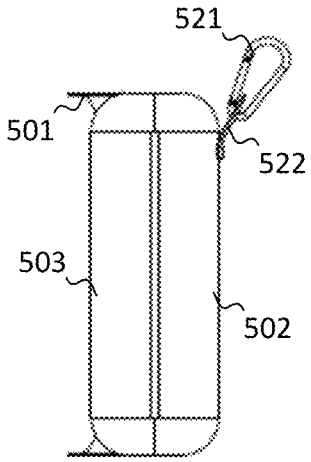
FIG. 11D shows a side view of an open oblong cross section, multi-compartment container with a loop/strap, according to another exemplary embodiment of the present subject disclosure.
Figure 11E:
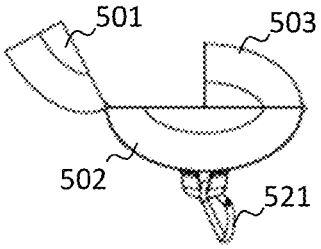
FIG. 11E shows an end view of an open oblong cross section, multi-compartment container with a loop/strap, according to another exemplary embodiment of the present subject disclosure.
Figure 12:
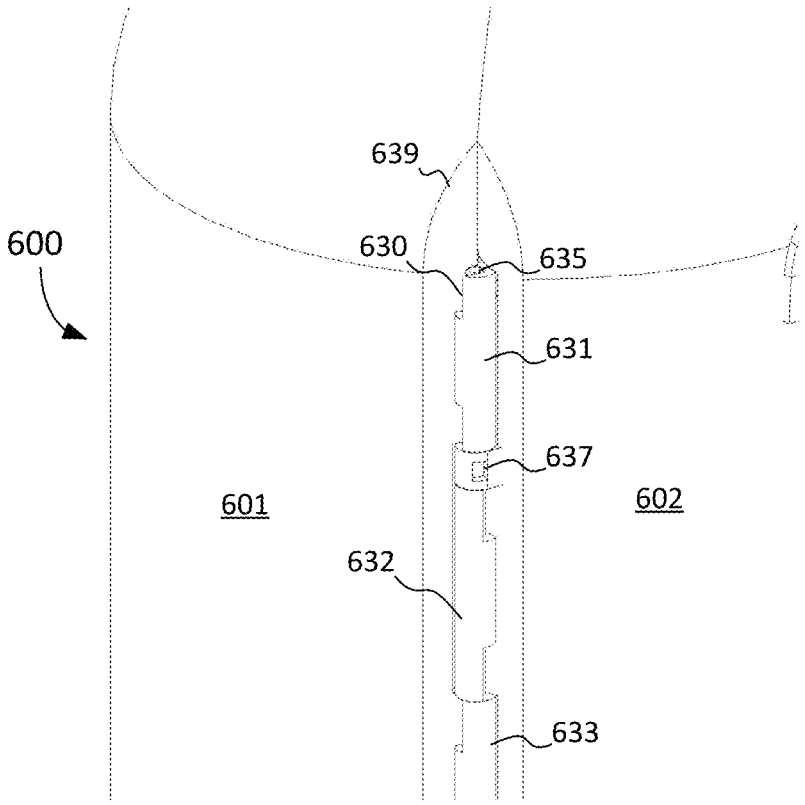
FIG. 12 shows a front perspective view of a hinge joint of a multi-compartment container, according to another exemplary embodiment of the present subject disclosure.

In this embodiment, as best shown in FIG. 11E, the central compartment 502 is larger than each of the two outer compartments 501 and 503. This allows for a larger volume of space within the central compartment 502 to accommodate larger or bulkier items. For sake of simplicity, central compartment 502 is shown with a 180 degree span, while each of the end compartments has a 90 degree span. However, all three compartments may be different sizes, as long as they can connect together to form an oblong cross section. The central compartment wall 502 is shown as being the largest, for sake of simplicity, but either of the end compartments 501, 503 may be the largest compartment. Further, the device 500 may have four or more compartment walls (similar to device 400 in FIGS. 10A-10E) which combine to create an oblong cross section. Finally, the asymmetric compartment walls 501, 502, 503 may contain one or more combinations of a loop/strap 141/142 (FIG. 2), pocket 143 (FIG. 3), wallet 144 (FIG. 4), speaker 146 (FIG. 5), window 147 (FIG. 6), or electronics 250/251/252 (FIG. 8).

FIG. 12 shows an exemplary embodiment of a low profile hinge mechanism 600 that is used in the various embodiments presented herein. Two adjacent compartment walls 601, 602 are connected at hinge 630, which includes hinge components 631, 632, 633, etc. Only a portion of hinge 630 is shown, but the hinge components extend along the sides connecting the two compartment walls 601, 602. Hinge component 632 is fixedly connected to wall compartment 601. Hinge components 631 and 633 are fixedly connected to compartment wall 602. Hinge components 631, 632, 633, etc., rotate about an internal hinge pin 635 that may span the entire length of the hinge 630. Further, a hinge connector 637 is an extension portion of the separator walls (e.g., separator walls 113, 114) which allows the separator walls to rotate about the hinge pin 635 to separate adjacent compartments within the device. During opening of the device, compartment wall 601 slides to cover hinge components 631, 633, and compartment wall 602 slides to cover hinge component 632.

Hinge gap 639 is formed by an indentation on both adjacent sides of compartment walls 601, 602 such that the hinge 630 is deep enough within the gap 639 so that no moving part of the hinge 630 extends beyond the outer surface plane created by the adjacent compartment walls 601/602. As shown in, for example, FIG. 1E, and other equivalent figures of the closed device, the hinge gap 639 maintains the hinge 630 below an outer surface at all times, as is evident from the end view of the device. This configuration of a hinge gap 630 minimizes the overall profile shape of the device in its various embodiments, and prevents or eliminates the hinge from getting caught up or entangled with clothes or other external device items during the opening/closing of the device. The hinge 600 shown and described here is not the only type which may be used with the devices shown and described herein. Other hinges may be used, including but not limited to hinges which project out from the sides of the compartment walls, accordion like hinges, and the like.

As well understood after consideration of the above described embodiments, one of the unique aspects of the present subject disclosure is its ability house multiple personal items, such as eyewear, in a parallel fashion such that the eyewear take up as little room as possible. This allows the entire container to be easily placed into a backpack, luggage, or other carrier, thereby taking up much less room than would be needed if each of the eyewear was carried in its own eyewear case. Furthermore, because all of the eyewear is kept together, there is less chance of one of the eyewear getting lost as would be common wearing multiple eyewear are carried in separate eyewear cases.

One of the many novel features of this subject disclosure is its ease in use. To use the container, the securing mechanism is opened, the cylinder is then simply unrolled as each compartment is separated by an adjoining compartment through a moveable, foldable, and/or living hinge, an eyewear is removed or inserted, and then rolled again to form a cylinder.

Additionally, a strap (not shown) may be used to partially or completely surround the outer circumference of the cylindrical body. For example, a clip on the either end or middle external surface of the container may be used to attach the container of eyewear to a rope or clip in a tent during camping so that the container is easily accessible by a user who is camping.

The entire interior of the container may be lined with a material which would not harm the surface of the eyewear, including the frame and lenses. The interior material may be, for example, a soft cloth (felt, silk, etc.), rubber, plastic, bubble wrap, or similar, or combinations thereof. The interior material should preferably be soft enough to cushion the impact of the eyewear during handling or transport, and to prevent breakage of the eyewear if the container is dropped. An unbreakable mirror or reflective surface may be included on an inside or outside surface of the device to provide a convenient reflective surface.

In some embodiments, the interior may also include thin, soft jackets (not shown) to provide additional protection for each eyewear. The jackets may be composed of the same material as the interior of the container and have a sack-like shape with an elastic opening to allow the user to insert and withdraw the eyewear therein.

In further embodiments, an elastic, clip, strap, or other securing mechanism (not shown) may be included within the container to secure additional items therein, including but not limited to, cleaning towelette, cleaning solution, eyeglass repair kits, etc.

The exterior of the container may be laminated with or made of a harder, more durable material, such as plastic, rubber, wood, thicker cloth, or combinations thereof. Preferably, the exterior structure of the container is able to withstand the impact of a drop or fall without caving in and crushing the eyewear placed inside. In one exemplary embodiment, the exterior of the container may be composed of one or more different materials, including one that is transparent, such as a transparent plastic or plexiglass, or glass, as discussed above.

The foregoing disclosure of the exemplary embodiments of the present subject disclosure has been presented for purposes of illustration and description. It is not intended to be exhaustive or to limit the subject disclosure to the precise forms disclosed. Many variations and modifications of the embodiments described herein will be apparent to one of ordinary skill in the art in light of the above disclosure. The scope of the subject disclosure is to be defined only by the claims appended hereto, and by their equivalents.

What has been described above includes examples that provide advantages of the subject disclosure. It is, of course, not possible to describe every conceivable combination of components or methodologies for purposes of describing the subject disclosure, but one of ordinary skill in the art may recognize that many further combinations and permutations of the claimed subject matter are possible. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim.

Further, in describing representative embodiments of the present subject disclosure, the specification may have presented the method and/or process of the present subject disclosure as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present subject disclosure should not be limited to the performance of their steps in the order written, and one skilled in the art can readily appreciate that the sequences may be varied and still remain within the spirit and scope of the present subject disclosure.

What is claimed is:

1. A container, the container comprising:

a housing having a cylindrical middle section with a given length, a first hemisphere section at a first end of the cylindrical middle section and a second hemisphere section at a second end of the cylindrical middle section;

at least three compartments formed by the housing, including two outer compartments and a central compartment with two opposing sides, wherein each compartment is adapted to house a single item;

wherein each opposing side of the central compartment is connected to one of the two outer compartments through a hinge, each hinge including a separator wall and an internal hinge pin, wherein both the separator wall and hinge pin span the length of the cylindrical middle section, wherein each separator wall rotates about the respective hinge independent of rotation of the compartments and keeps each item separate from an item housed in an adjacent compartment; and a hinge gap extending the length of the cylindrical middle section and partially into the first hemisphere section and the second hemisphere section, and formed by an indentation on adjacent sides of adjacent compartment walls such that the shared hinge is deep enough within the hinge gap so that no moving part of the hinge extends beyond an outer surface plane created by the adjacent compartment walls; and a lock to secure the housing in a closed configuration to maintain the single item within the compartment.

2. The container in claim 1, wherein all compartments are identical in size.

3. The container in claim 1, wherein one compartment is larger than the other compartments.

4. The container in claim 1, wherein the two outer compartments detachably connect with each other using the lock.

5. The container in claim 4, wherein the lock includes a magnet.

6. The container in claim 1, further comprising four compartments including two central compartments and the two outer compartments, wherein the four compartments are identical in size.

7. The container in claim 1, further comprising a loop or strap positioned on an interior wall of one of the compartments.

8. The container in claim 1, further comprising a pocket positioned on an interior wall of one of the compartments with a pocket opening in a longitudinal axis of the compartment on which the pocket is positioned.

9. The container in claim 1, further comprising a wallet positioned on an interior wall of one of the compartments with a wallet opening perpendicular to a longitudinal axis of the compartment on which the wallet is positioned.

10. The container in claim 1, further comprising a speaker positioned on an interior wall of one of the compartments.

11. The container in claim 1, further comprising a transparent window positioned in a wall of one of the compartments.

12. The container in claim 1, further comprising a flashlight with a power source positioned on one of the compartments.

13. The container in claim 1, further comprising a hook positioned on an exterior of the housing.

14. The container in claim 1, wherein the cylindrical middle section has a circular cross section taken perpendicular to a longitudinal axis of the housing.

15. The container in claim 1, wherein the cylindrical middle section has an oblong cross section taken perpendicular to a longitudinal axis of the housing.

16. The container in claim 1, wherein the hinge comprises a low profile hinge such that the hinge is positioned below an external surface of the housing when the housing is closed.

17. A container, the container comprising:

a housing having a cylindrical middle section with a given length, a first hemisphere section at a first end of the cylindrical middle section and a second hemisphere section at a second end of the cylindrical middle section;

a plurality of compartments formed by the housing, including two outer compartments and a central compartment with two opposing sides, wherein each compartment is adapted to house a single item;

wherein each opposing side of the central compartment is connected to one of the two outer compartments through a hinge, each hinge including a separator wall and an internal hinge pin, both the separator wall and hinge pin span the length of the cylindrical middle section, wherein each separator wall rotates about the respective hinge independent of rotation of the compartments and keeps each item separate from an item housed in an adjacent compartment; and wherein the hinge comprises a low profile hinge such that the hinge is positioned below an external surface of the housing when the housing is closed;

a hinge gap extending the length of the cylindrical middle section and partially into the first hemisphere section and the second hemisphere section, and formed by an indentation on adjacent sides of adjacent compartment walls such that the hinge is deep enough within the hinge gap so that no moving part of the hinge extends beyond an outer surface plane created by the adjacent compartment walls;

a lock to secure the housing in a closed configuration to maintain the single item within the compartment.

18. A container, the container comprising:

a housing with a circular cross section having a cylindrical middle section with a given length, a first hemisphere section at a first end of the cylindrical middle section and a second hemisphere section at a second end of the cylindrical middle section;

a plurality of identically sized compartments formed by the housing, including two outer compartments and a central compartment with two opposing sides, wherein each compartment is adapted to house a single item;

wherein each opposing side of the central compartment is connected to one of the two outer compartments through a hinge, each hinge including a separator wall and an internal hinge pin, both the separator wall and hinge pin span the length of the cylindrical middle section, wherein each separator wall rotates about the respective hinge independent of rotation of the compartments and keeps each item separate from an item housed in an adjacent compartment; and wherein the hinge comprises a low profile hinge such that the hinge is positioned below an external surface of the housing when the housing is closed;

a hinge gap extending the length of the cylindrical middle section and partially into the first hemisphere section and the second hemisphere section, and formed by an indentation on adjacent sides of adjacent compartment walls such that the hinge is deep enough within the hinge gap so that no moving part of the hinge extends beyond an outer surface plane created by the adjacent compartment walls; and a magnet to secure the housing in a closed configuration by connecting the two outer compartments together.

* * * * *